United States Patent [19]

Miyazaki et al.

[11] 4,282,701

[45] Aug. 11, 1981

[54] METHOD OF SETTING PACKAGING PAPER IN COIN PACKAGING MACHINE

[75] Inventors: Yorizo Miyazaki; Katusuke Furuya, both of Tokyo, Japan

[73] Assignee: Laurel Bank Machine Co., Ltd., Tokyo, Japan

[21] Appl. No.: 77,276

[22] Filed: Sep. 20, 1979

[30] Foreign Application Priority Data

Sep. 22, 1978 [JP] Japan ..... 53/117104

[51] Int. Cl.[3] ..... B65B 11/04

[52] U.S. Cl. ..... 53/465; 53/212

[58] Field of Search ..... 53/465, 212, 52; 133/1 A, 8 A; 83/564, 649, 650

[56] References Cited

U.S. PATENT DOCUMENTS

| | | | |
|---|---|---|---|
| 3,350,835 | 11/1967 | Becker | 53/212 |
| 3,938,303 | 2/1976 | Ushio | 53/212 |
| 4,047,361 | 9/1977 | Ono | 53/212 |
| 4,089,151 | 5/1978 | Bergman | 53/212 |
| 4,138,834 | 2/1979 | Nobuhiro | 53/212 |

*Primary Examiner*—John Sipos

*Attorney, Agent, or Firm*—Fleit & Jacobson

[57] ABSTRACT

Disclosed herein is a method of setting packaging papers. The method is used in a coin packaging machine wherein the position of a cutting blade is determined to cut off a necessary amount of a packaging paper suitable for the diameter of coins to be packaged, in accordance with the coin kind setting operation. The method comprises the steps of, shifting the cutting blade to a predetermined position for facilitating the cutting operation when a portion of the packaging paper is required to be cut off, and returning the cutting blade to a preset position for the restarting of packaging operation after the portion of the packaging paper has been cut off.

2 Claims, 3 Drawing Figures

METHOD OF SETTING PACKAGING PAPER IN COIN PACKAGING MACHINE

BACKGROUND OF THE INVENTION

1. Field of the Invention

The present invention relates to a packaging paper setting method in a coin packaging machine provided with a device for automatically feeding packaging papers cut into various lengths differing according to the diameter of coins to be packaged. More particularly, the present invention relates to a method of setting coin packaging papers in such coin packaging machine, in which on initiation of the packaging operation, a cutting blade device is automatically moved and set at a position where the top end of the packaging paper is readily cut by a cutting blade of a cutting device.

2. Description of the Prior Art

In conventional coin packaging machines, when the kind of coins to be handled is set by a coin kind setting button or the like, the position of a coin kind setting member is automatically determined by a coin kind setting mechanism, and simultaneously, the position of a cutting blade device is automatically determined so that a packaging paper is cut in a length corresponding to the diameter of the set kind of coins. In other words, the cutting blade is moved in the horizontal direction to determine the paper feed distance, and a packaging paper is fed along a length corresponding to the diameter of coins to be packaged. In the conventional packaging machines, however, if the coin kind is once set, the cutting blade is not moved. For example, in case of coins having a small diameter, the cutting blade is shifted to the vicinity of packaging roller and set at this position, and if it is intended to perform paper cutting in this state so as to set the leading end portion of the packaging paper, the paper cannot be smoothly pulled in the paper cutting direction because of the presence of devices such as a paper guide plate, etc. Accordingly, the paper cutting operation is very troublesome in case of coins having a small diameter.

SUMMARY OF THE INVENTION

It is a primary object of the present invention to provide a packaging paper setting method in a coin packaging machine in which the foregoing disadvantages involved in the conventional technique are eliminated. More specifically, according to the present invention, when it is intended to cut a packaging paper, for example, when a fresh packaging paper is supplied or when the packaging machine is stopped because of detection of a trouble in the paper feeding operation or detection of non-performance of paper cutting through paper feeding is detected, the cutting blade is shifted to a position where paper cutting can be performed very smoothly and conveniently irrespectively of the kind of coins to be packaged.

In accordance with the present invention, there is provided a method of setting packaging papers in a coin packaging machine wherein the position of a cutting blade is determined to cut off a necessary amount of a packaging paper suitable for the diameter of coins to be packaged, in accordance with the coin kind setting operation, comprising the steps of shifting the cutting blade to a predetermined position for facilitating the cutting operation when a portion of the packaging paper is required to be cut off, and returning the cutting blade to a preset position for the restarting of packaging operation after said portion of the packaging paper has been cut off.

DESCRIPTION OF THE DRAWINGS

Other objects and advantages of the present invention will become apparent from the following description made with reference to the accompanying drawings, in which.

DETAILED DESCRIPTION OF THE PREFERRED EMBODIMENTS

Figure 1:
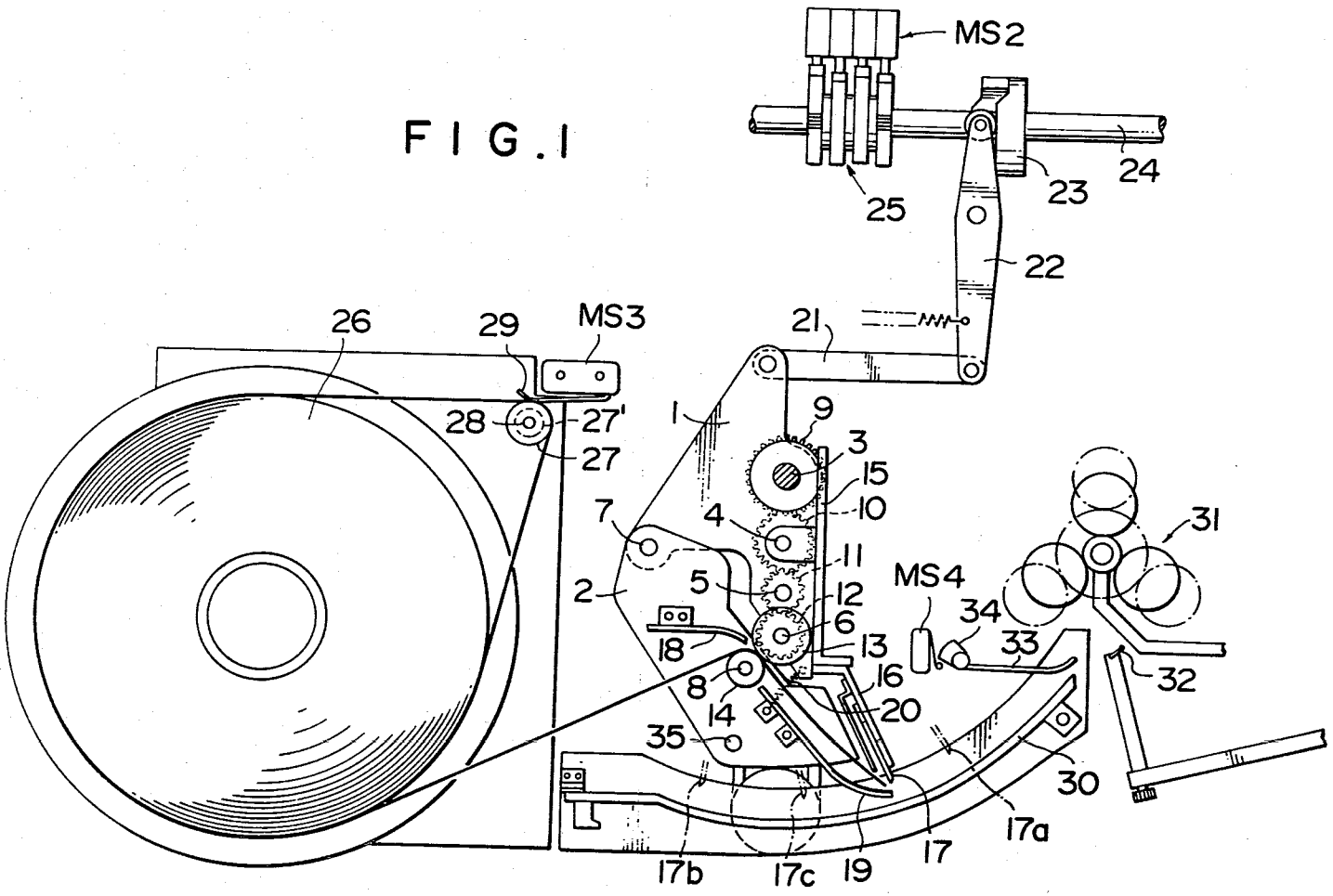
FIG. 1 is a top plan view showing the main portion of a coin packaging machine in which a method according to the present invention is used.
Figure 2:
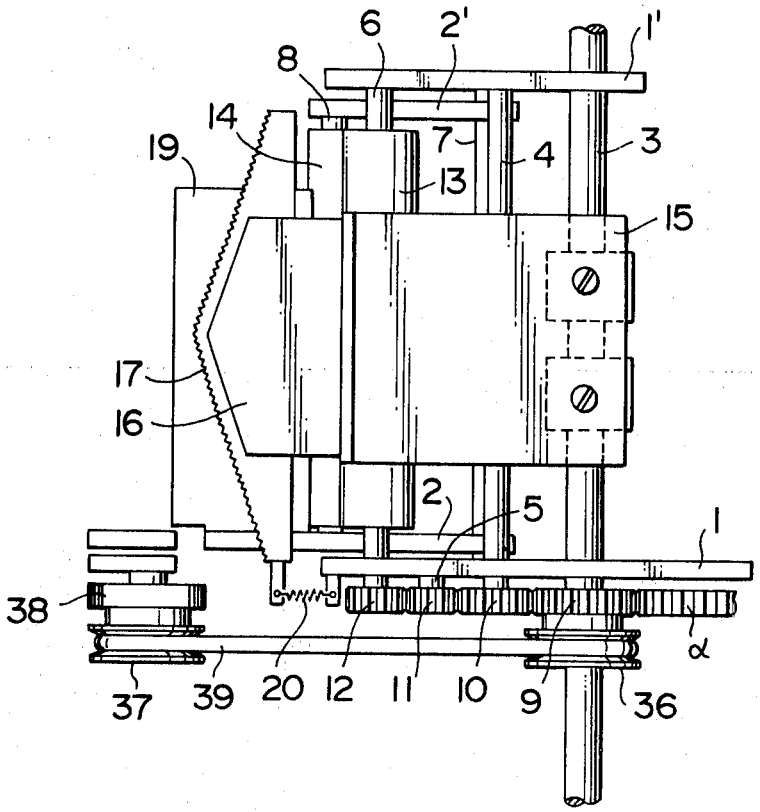
FIG. 2 is a side view showing the main portion of the coin packaging machine.

The present invention will now be described in detail by reference to embodiments shown in the drawings.

Plates 1 and 1' for setting the position of a cutting blade are attached rotatably around a shaft 3. Gears 9, 10 and 11 are rotatably attached to shafts 3, 4 and 5, respectively, to transmit the rotation of a driving device not shown, discontinuously by an electromagnetic clutch to a gear $\alpha$ and, therefore, the gears 9, 10 and 11 which are meshed engaged with the gear $\alpha$. A gear 12 and a paper feed roller 13 are fixed to a shaft 6 to transmit the above-mentioned rotation to the paper feed roller 13. A member 15 for setting the vertical position of a cutting blade and a cutting blade attachment plate 16 fixed thereto are vertically movably attached to the shafts 3 and 4. A cutting blade 17 is attached to the top end of the attachment plate 16.

Driven roller attachment plates 2 and 2' are disposed so that they can turn around a shaft 7 attached to the cutting blade position setting plates 1 and 1'. Paper guide plates 18 and 19 and a shaft 8 are attached to the plates 2 and 2', and a driven roller 14 is rotatably attached to the shaft 8. The driven roller attachment plates 2 and 2' and the cutting blade position setting plates 1 and 1' are attracted to each other by a spring 20, and the feed roller 13 is press-contacted to the driven roller 14.

The set position of the cutting blade position setting plate 1 is controlled to be rotated about the shaft 3 by a position setting cam 23 through a link 21 and an arm 22. More specifically, a cam shaft 24 is rotated by a driving motor (not shown) or the like, and the cam 23 and cutting blade position detecting cams 25 fixed to the cam shaft 24 are rotated. According to this rotation, the cutting blade position setting plates 1 and 1' are rotated about the shaft 3, and position detection is performed by the detection cams 25 and cutting blade position detecting micro-switches MS2 thereof.

When a packaging paper 26 is fed through a packaging paper detecting roller 27 rotatably attached to a shaft 28, a detecting lever 29 of a microswitch MS3 facing a groove 27' formed in the circumference of the roller 27 does not fall into the groove 27', and, thus, the microswitch MS3 is turned on to generate a packaging paper detecting signal. When there is not present the packaging paper, the lever 29 falls into the groove 27', and, thus, the microswitch MS3 is turned off to generate a packaging paper absence signal.

The packaging paper 26 is gripped between the paper feed roller 13 and driven roller 14 and fed to packaging rollers 31 while being guided by a paper guide plate 30, and as in the conventional machine, according to the difference between the packaging speed and the feed speed of the paper feed roller 13, the packaging paper 26 is cut in a predetermined length by the cutting blade 17 and the packaging operation is performed by clamping claws 32. In this paper cutting operation, a microswitch MS4 is put on by a detecting lever 33 and a cam 34 to generate a detection signal indicating whether the paper is cut completely or the paper cutting is incomplete.

When coins having a small diameter are packaged, upon setting of the coin kind, the position setting cam 23 is rotated and the cutting blade position setting plates 1 and 1' are rotated through the arm 22 and link 21 in the counterclockwise direction about the shaft 3 to set the cutting blade 17 to a position close to the packaging rollers 31, for example, a position 17*a* as shown in dotted lines. Even if it is desired to cut the leading end of the packaging paper 26 because the leading end of the packaging paper 26 is not of a predetermined cut shape or for other reason, manual cutting operation is very difficult since the detecting lever 33, the packaging rollers 31 and other members are present in the vicinity of the cutting blade 17*a*. Accordingly, the cutting blade position setting plates 1 and 1' are rotated in the clockwise direction about the shaft 3, for example, by a handle particularly mounted on the cutting blade attachment plate 16 or the position setting plate 1, whereby the cutting blade 17 can be shifted to, for example, a position 17*b* or 17*c* as shown in dotted lines. At this position, cutting may be performed very easily and the leading end of the paper is cut into a predetermined shape. With this rotation, also the driven roller attachment plates 2 and 2' are rotated and the packaging paper 26 is maintained to be gripped between the feed roller 13 and driven roller 14 by action of the spring 20. Accordingly, the packaging paper is prevented from separating from the predetermined position.

When the packaging paper 26 is inserted between both the rollers 13 and 14, the driven roller attachment plate 2 is rotated by the handle 35 in the clockwise direction about the shaft 7 to produce a clearance between both the rollers 13 and 14 and the packaging paper 26 is inserted into this clearance. Alternately, a knob 38 is rotated to rotate a pulley 37 fixed to the knob 38 and a pulley 36 driven through a belt 39 and fixed to the gear 9. Thus, the rollers 13, 14 are rotated through the gears 9 to 12 by a belt 39 to effect insertion of the packaging paper.

In the foregoing embodiment, the position of the cutting blade 17 is manually changed. Alternatively, in the present invention, the position of the cutting blade can be detected and set automatically as hereinafter described. A preferred embodiment of a control circuit suitable for this automatic detection and setting will now be described by reference to FIG. 3.

A start control circuit A is arranged so that when the operation of counting coins and the operation of the packaging machine are started by a start button, this start is retained by an internal flip-flop or the like. A latch output is emitted from an output terminal Q1 of the start control circuit A and put in an AND gate. A one-shot pulse for resetting a flip-flop or the like in a paper trouble detecting circuit B, described hereinafter, is put out from an output terminal Q2 as every latch is emitted. The circuit A is arranged so that when a low level signal is put in an input terminal $\overline{R}$, a one-shot pulse for resetting the start retaining circuit is generated to effect resetting.

Figure 3:
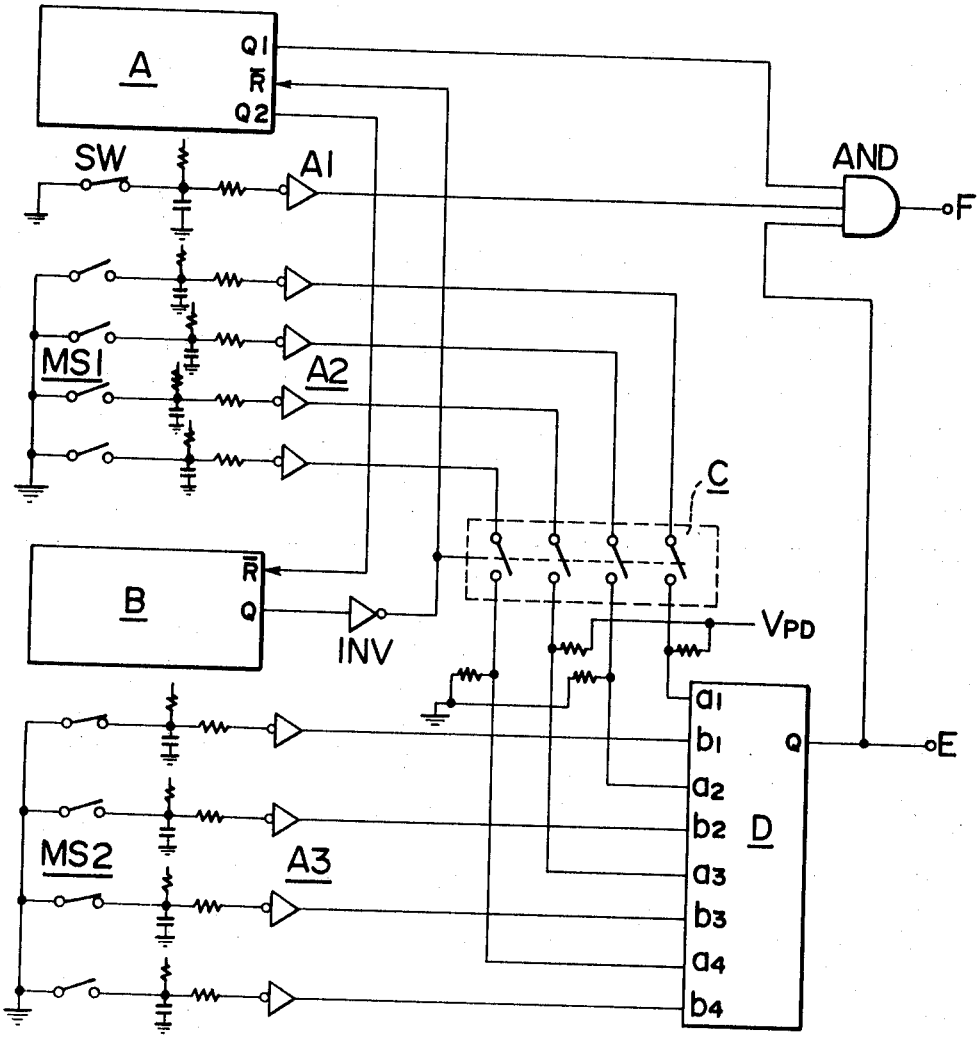
FIG. 3 is an electric circuit diagram illustrating an example of an electric circuit for use in the method according to the present invention.

The paper trouble detecting circuit B is arranged so that when the packaging paper 26 detected by the microswitch MS3 (see FIG. 1) is lost or consumed or when a trouble is caused in feeding of the packaging paper 26, an internal flip-flop or the like is set. When a high level signal is emitted from an output terminal Q of the circuit B, a low level signal is given to control lines (indicated by dotted lines in FIG. 3) of analog switches C through an inversing circuit INV to open the respective switches as shown in FIG. 3. The level signal is put in an input terminal $\overline{R}$ of the start control circuit A through the inversing circuit INV.

A packaging-counting changeover switch SW is disposed to determine whether the packaging operation or the counting operation is carried out. In the present embodiment, the switch SW is set at the packaging position. In this state, an input side of an inversing circuit A1 is grounded to earth to put a high level signal to an AND circuit AND.

Coin kind setting microswitches MS1 are changed over by, for example, a coin kind setting dial, a coin kind setting button or the like. The outputs of the microswitches MS1 are put in inversing circuits A2 and the outputs of the circuits A2 are put in control lines of the analog switches C. The outputs of the control lines are connected to input terminals a1 to a4 of a position setting and detecting circuit D, described hereinafter, while the intermediate portions are connected to a power source VPD through optional lines and resistors as shown in FIG. 3 or they are grounded to earth through resistors. Cutter position detecting microswitches MS2 are disposed to change the position of the cutter according to the set coin kind and detect the position of the cutter. The outputs of these microswitches MS2 are put in reversing circuits A3 and the outputs of the circuits A3 are connected to input terminals b1 to b4 of the position setting and detecting circuit D.

The position setting and detecting circuit D is arranged so that set coin kind and cutter position informations put in the input terminals a1 to a4 and b1 to b4 are processed as 4-bit codes, respectively, and it is checked whether or not both the codes are in matching with each other, and that when both the codes are in matching with each other, a high level signal is emitted from the output terminal Q and when both the codes are not in matching with each other, a low level signal is emitted from the output terminal Q. The output signal of the circuit D is put in the AND gate and is utilized as a driving control signal for a cutter position setting motor. More specifically, when both the codes are not in matching with each other, the setting motor is driven by the low level signal, and when both the codes are in matching with each other, the setting motor is stopped by the high level signal.

The operation procedures will now be described in detail.

When the coin kind is set according to a packaging mode, the microswitches MS1 are changed over and the coin kind code is put in the position setting and detecting circuit D and is compared with the cutter position code by the microswitches MS2. When the mismatching is detected, the AND gate is closed and the cutting blade setting motor is started by the driving control signal. During the period of this mismatching, even if the start switch is put on, since the AND gate is closed, no packaging mode start signal is not emitted and the counting or packaging operation is not started. By driving of the setting motor, the position of the cutting blade is shifted for a while and the microswitches MS2 are changed over. When the cutter position code becomes in matching with the coin kind code, the matching signal is emitted by the position setting and detecting circuit D to stop the setting motor and open the AND gate, and if the start switch is put on in this state, a packaging mode starting signal F is put out to start the counting and packaging operations.

When it is detected during the packaging operation that the packaging paper is lost or consumed or a paper feed trouble or the like is caused, a high level signal is emitted from the output terminal Q of the paper trouble detecting circuit B to acuate the analog switches C to open the control lines as shown in FIG. 3 and reset the start retention in the start control circuit A. When the analog switches C are opened, the preliminarily set coin kind code for facilitating the paper cutting operation is put in the input terminals a1 to a4 of the position setting and detecting circuit D. If the modes are not in matching with other at this point, the cutter setting motor is driven to shift the cutter. When the cutter is set at a position predetermined according to the coin kind (the state of MS2 shown in FIG. 3), the setting motor is stopped and the packaging paper is reset by an operator.

When the start switch is put on again after completion of setting of the packaging paper, a high level signal is emitted from the output terminal Q1 of the start control circuit A and a high level one-shot pulse is emitted from the output terminal Q2, and they act as the start retention signal and the reset signal for the paper trouble detecting circuit B. By this reset signal, the control lines of the analog switches C are communicated, and the coin kind code from the coin kind setting microswitches MS1 becomes effective. At this point, if the cutting blade has been shifted because of a trouble in the paper feeding operation or other paper trouble, both the codes are not in matching with each other, and a driving control signal for the setting motor is emitted so as to return the cutting blade to the original position. Accordingly, emission of the packaging mode start signal F is restrained for a while, and on completion of setting of the cutter, the packaging operation is started again.

In the foregoing embodiments, the cutting blade is set at a position for facilitating the paper cutting operation according to the coin kind. In the present embodiment, the cutting blade may be set a peculiar position exclusively used for the paper cutting operation.

In the present invention, by virtue of the above-mentioned structural feature in the electric circuit, when it is necessary to perform the paper cutting operation, the cutting blade is automatically shifted to a predetermined position. Accordingly, the paper cutting operation can be remarkably facilitated, and at the time of re-starting, the cutter blade is returned to the original position and the operation can be re-started very conveniently.

What is claimed is:

1. A method of setting a packaging paper in a coin packaging machine comprising a feeding and cutting assembly having a pair of rollers for feeding a packaging paper and a cutting blade for cutting the same, the cutting blade being positioned between a roll of packaging paper and packaging rollers for applying the packaging paper to coins to be packaged, said feeding and cutting assembly being movable to set its position in accordance with the diameter of coins to be packaged, which method comprises the steps of:

(a) setting the feeding and cutting assembly in a first predetermined position in accordance with the diameter of coins to be packaged simultaneous with memorizing the position of the feeding and cutting assembly;

(b) automatically shifting the feeding and cutting assembly by control means to a second predetermined position for facilitating loading of a leading end of a new roll of packaging paper on the assembly between the pair of rollers in response to the detection of a small amount of a previous roll of packaging paper; and (c) automatically returning the feeding and cutting assembly by said control means to the memorized position for the restarting of packaging operation when the loading of the new roll has been completed.

2. A method as set forth in claim 1 wherein said step of automatically shifting said assembly by said control means comprises emitting a detection signal by a means for detecting the necessity of shifting the cutting blade to said second predetermined position for facilitating the loading operation and then shifting the feeding and cutting assembly to said second predetermined position in response to said detection signal.

* * * * *